US008899283B2

(12) United States Patent
De Crasto

(10) Patent No.: US 8,899,283 B2
(45) Date of Patent: Dec. 2, 2014

(54) DEVICE FOR FRACTIONING A VOLUME OF LIQUID

(75) Inventor: Laurent De Crasto, Paris (FR)

(73) Assignee: Wine In Tube—Wit France, Saint Firmin des Pres (FR)

( * ) Notice: Subject to any disclaimer, the term of this patent is extended or adjusted under 35 U.S.C. 154(b) by 441 days.

(21) Appl. No.: 13/254,757

(22) PCT Filed: Mar. 3, 2010

(86) PCT No.: PCT/EP2010/052650

§ 371 (c)(1),
(2), (4) Date: Oct. 17, 2011

(87) PCT Pub. No.: WO2010/100171

PCT Pub. Date: Sep. 10, 2010

(65) Prior Publication Data

US 2012/0031527 A1 Feb. 9, 2012

(30) Foreign Application Priority Data

Mar. 4, 2009 (FR) ..... 09 00976

(51) Int. Cl.
*B65B 1/04* (2006.01)
*B67C 3/04* (2006.01)

(52) U.S. Cl.
CPC ..... *B67C 3/04* (2013.01)
USPC ..... 141/236; 141/21; 141/25; 141/234; 141/302

(58) Field of Classification Search
CPC .... B65B 31/04; B65B 31/031; B65B 31/042; B65B 31/044
USPC ..... 141/21–27, 54, 57, 63, 64, 301, 302, 141/320–323, 234, 236
See application file for complete search history.

(56) References Cited

U.S. PATENT DOCUMENTS

| | | | | | |
|---|---|---|---|---|---|
| 3,580,298 | A | | 5/1971 | Trusselle | |
| 4,296,785 | A | * | 10/1981 | Vitello et al. | 141/105 |
| 4,560,089 | A | * | 12/1985 | McMillin et al. | 222/14 |
| 4,583,346 | A | * | 4/1986 | Kameda | 53/431 |
| 4,859,375 | A | * | 8/1989 | Lipisko et al. | 261/20 |
| 5,454,408 | A | * | 10/1995 | DiBella et al. | 141/197 |
| 5,586,587 | A | * | 12/1996 | Leininger et al. | 141/196 |
| 5,586,588 | A | * | 12/1996 | Knox | 141/285 |
| 6,557,459 | B1 | * | 5/2003 | Phelps et al. | 99/323.1 |
| 7,533,701 | B2 | * | 5/2009 | Gadzic et al. | 141/54 |
| 2006/0237094 | A1 | | 10/2006 | Roebuck | |
| 2006/0283523 | A1 | | 12/2006 | Gadzic et al. | |
| 2007/0023100 | A1 | | 2/2007 | Blichmann | |

* cited by examiner

*Primary Examiner* — Timothy L Maust
(74) *Attorney, Agent, or Firm* — Muncy, Geissler, Olds & Lowe, P.C.

(57) ABSTRACT

A device for dividing up a volume of liquid contained in an original container by filling bottles that are smaller than the original container, including a source of pressurized gas, a first line running from the source of pressurized gas and opening into the original container so as to place it under pressure, and a line for withdrawing the contents of the original container, connecting the latter to one of the smaller bottles. A second line runs from the pressure source and ends in the smaller bottle to be filled. Means are provided for closing and opening the first and second lines and a member is provided for activating the means for closing/opening so as to open the second line then the pressurization line in sequence, and close these same lines in sequence in the reverse order.

4 Claims, 2 Drawing Sheets

DEVICE FOR FRACTIONING A VOLUME OF LIQUID

The present invention relates to a device for dividing up a defined amount of liquid that is affected by contact with the atmosphere, by transfer from a first container to a plurality of second containers of smaller volume.

BACKGROUND OF THE INVENTION

The sale of certain culinary liquids such as wine requires them to be packaged in containers the volume of which is far smaller than that of an ordinary bottle (75 cl). Thus bottles having volumes of 100, 125, 150 cubic centimeters etc. are produced either to provide a single helping to a consumer or as samples for sales purposes, testing, etc.

In certain cases these smaller bottles are filled directly at the point of bottling, but in other cases, the majority of cases at the current time, they are filled from other larger bottles that are already made up and have to be emptied so as to divide up the contents thereof.

Wine is a product that is affected by oxygen. The transferring operations must therefore minimize as much as possible contact between the liquid and the ambient atmosphere. This requirement is well known.

SUBJECT OF THE INVENTION

The present invention provides a device in order to meet this requirement, the device being simple, easy to use and economical, placing it within the means of any wine maker, making it possible for him to bottle samples of his product for example with a view to sale or testing of the latter.

BRIEF DESCRIPTION OF THE INVENTION

Specifically, the subject of the invention is therefore a device for dividing up a volume of liquid contained in an original container by filling bottles that are smaller than the original container, comprising:

- a source of pressurized gas;
- a first line running from the source of pressurized gas and opening into the original container so as to place it under pressure; and
- a line for withdrawing the contents of the original container, connecting the latter to one of the smaller bottles, characterized in that it comprises:

- a second line running from the pressure source and ending in the smaller bottle to be filled; and
- means, for closing and opening certain of said lines, activated so that gas flow starts in the second line before liquid starts to flow in the withdrawing line and stops after this flow of liquid has stopped.

Thus, using a single source of pressurized gas, for example nitrogen or carbon dioxide, the first activating operation firstly causes neutral gas to flow into the smaller bottle replacing the air contained therein with an inert atmosphere. This gas flow continues throughout the withdrawal of the wine, which flows into the smaller bottle filled with inert gas. The gas flow provides an oxygen-free atmosphere around the wine flowing from the outlet of the withdrawing line into the smaller bottle. Preferably, the flow of the wine is located in the center of the flow of the neutral gas.

Once the filling threshold of the smaller bottle has been reached, the operator stops the withdrawal. The flow of inert gas continues until the operator closes the second line.

It is possible during this time to stopper the smaller bottle under a protective atmosphere.

According to a first embodiment of the invention, the aforementioned means for opening and closing are placed on the first and second lines, a member for activating these means for closing/opening being arranged so as to open the second line then the pressurization line in sequence and close these same lines in sequence in the reverse order.

According to a second embodiment, the first and second lines, running from the source, have a common section, said means for closing and opening comprising a first means for opening/closing this common section and a second means for opening/closing the withdrawing line, a member for activating these means being arranged so as to open the common section then the withdrawing line in sequence and close these same lines in sequence in the reverse order.

In each of these embodiments, the means for opening and closing the lines are for example directional control slide valves, the opening and closing of the two lines being ensured by a single activating handle which comprises a lever hinged about a pivot at one of its ends and which acts on push-rods of the directional control valve slides, located in the angular sector through which the lever passes during its motion about its pivot.

Other features and advantages of the invention will become clear from the description given below of a nonlimiting exemplary embodiment.

BRIEF DESCRIPTION OF THE DRAWINGS

Reference is made to the appended drawings in which.

DETAILED DESCRIPTION OF THE INVENTION

Figure 1:
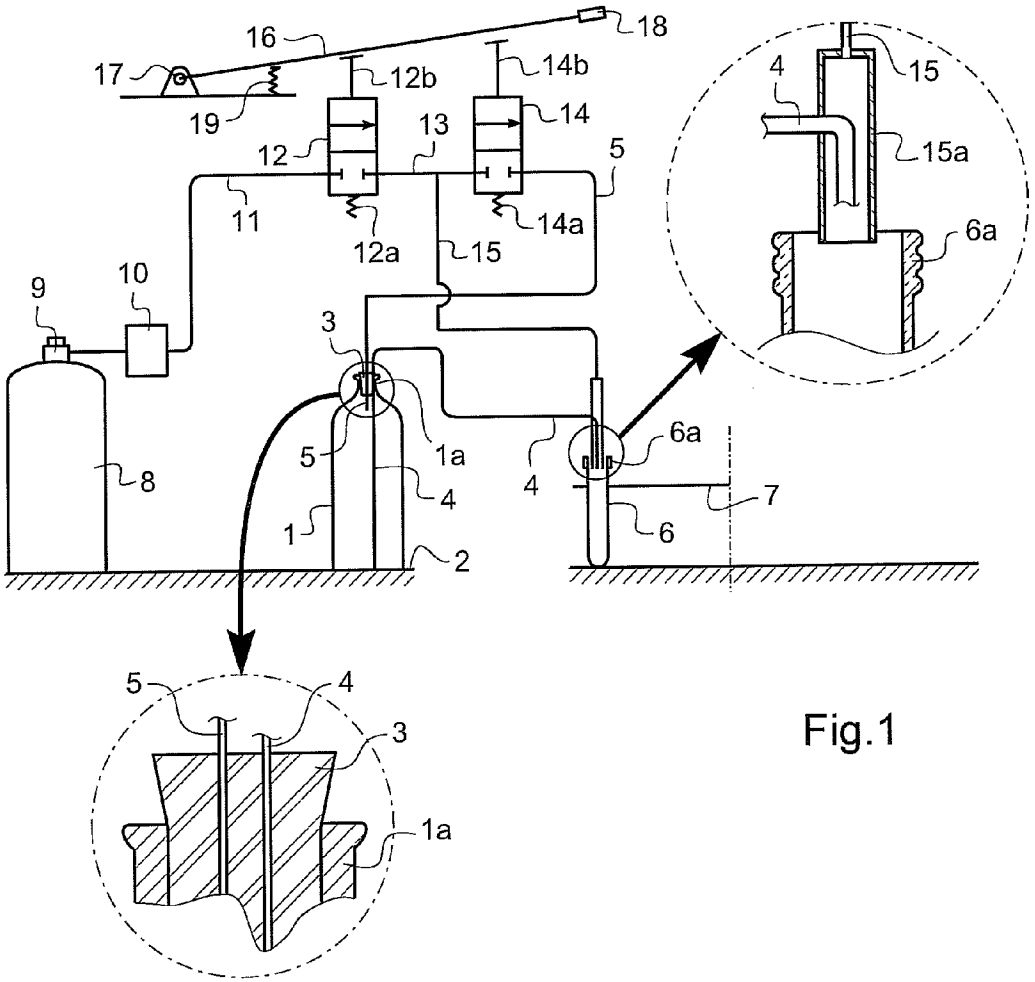
FIG. 1 is a diagram of a first embodiment of the invention.

Shown in the figures is a larger bottle 1 of which the content, for example wine, is to be divided up. To do this, the larger bottle is placed on a holder 2 of the piece of equipment according to the invention, so as to receive an end-piece 3 which sealingly closes the neck of the larger bottle. Two lines 4 and 5 pass through this end-piece 3.

The line 4 is a line for withdrawing the wine contained in the larger bottle. For this purpose it is submerged in the wine as far as the bottom of the larger bottle. The line 5 is a line for applying pressure to the larger bottle 1, which ends in the latter above the free surface of the wine.

The smaller bottle 6 shown here has the form of a test tube held vertical by a holder 7 of the piece of equipment. This holder may be a carrousel loaded with a plurality of smaller bottles, such as 6, which a rotation of the holder 7 makes pass from a station for filling the empty smaller bottles to a station for unloading these smaller bottles which have been filled when stationed under the opening of the withdrawing line 4.

The piece of equipment of the invention comprises a source of neutral gas (here carbon dioxide $CO_2$), for example a cylinder 8 of this gas under pressure. This gas cylinder is equipped, as is known, with a valve 9 for opening/closing its outlet, upstream of a pressure regulator 10 the outlet of which is connected to a line 11.

In FIG. 1, the line 11 ends at a normally closed, one-way, two-state, directional control valve 12 having one state in which the channel is closed, the line 11 then being blocked, and a second state in which the line 11 is placed in communication with a downstream line 13.

This downstream line 13 ends at the inlet of a second directional control valve 14 also a one-way, two-state, directional control valve having one state in which the channel is closed, the line 13 then being obstructed, and one state in which the line 13 is placed in communication with the line 5 for applying pressure to the larger bottle, downstream of the directional control valve 14.

The two directional control valves 12 and 14 are normally closed. If they are directional control slide valves, as illustrated, a return spring 12*a*, 14*a*, keeps them in this state whereas a push-rod 12*b*, 14*b* makes it possible to cause them to change state by overriding the effect of the return spring.

The directional control valves described above are only one exemplary embodiment and the invention is not limited to this example. Thus these directional control valves may be replaced by any other valve or solenoid valve made to close and open by means of an activating electrical signal.

Between the two directional control valves 12 and 14, the line 13 has a tap-off 15 which ends in the smaller bottle 6 or above the latter. This line 15 may also be equipped with a secondary pressure regulator (not shown) to favor flow rate over pressure at the outlet.

In FIG. 1, outside of the end-piece 3, the line 4 extends as far as the inlet 6*a* of the smaller bottle 6. Preferably, the opening 15*a* of the line 15 surrounds that of the withdrawing line 4 so as to form a pneumatic sheath around the stream of wine that will exit the withdrawing line.

Finally, an activating lever 16 illustrates the sequential activation of the directional control valves 12 and 14. This lever, hinged about a pivot 17, cooperates with the push-rods 12*b* and 14*b* that it encounters in sequence when it is operated using a handle 18 located at the opposite end to the pivot 17.

The piece of equipment according to the invention, in the embodiment thereof shown in FIG. 1, is operated in the following way.

After having placed the end-piece 3 in the neck 1*a* of the larger bottle 1 and having placed the common opening of the lines 4 and 15 above the smaller bottle 6, the valve 9 allowing withdrawal of carbon dioxide being open, the handle 18 is pressed downward. The lever 16 firstly encounters the push-rod 12*b* of the directional control valve 12 which changes state, from blocking line 11 to placing it in communication with line 13 and line 15. Gas then flows into the smaller bottle 6, replacing the air which it contains with the neutral gas supplied by the gas cylinder 8. Continuing the downward motion of the handle 18 causes the lever to depress the push-rod 14*b* of the directional control valve 14, which valve changes state, likewise opening communication between the line 3 and the line 5. The pressure of the gas in the larger bottle forces withdrawal from the latter via the line 4 and filling of the smaller bottle 6 under a controlled atmosphere, the flow of gas exiting the line 15 having not stopped.

By raising the handle 18 (or allowing it to rise under the effect of a return spring 19), the communication between line 5 and line 13 is first cut and the withdrawal stops. The change of state of the directional control valve 12 then makes the flow of flushing gas stop. The holder 7, if it is a carrousel, passes the full smaller bottle 6 to an unloading station or to a stoppering station before its removal from the device.

The example described above is simplified. In particular, it is recommended to provide the directional control valve 12 with a deformable contact between the push-rod and the lever (or any equivalent means) in order to enable relative movement between the two while the directional control valve 12 is and remains in its second state.

Figure 2:
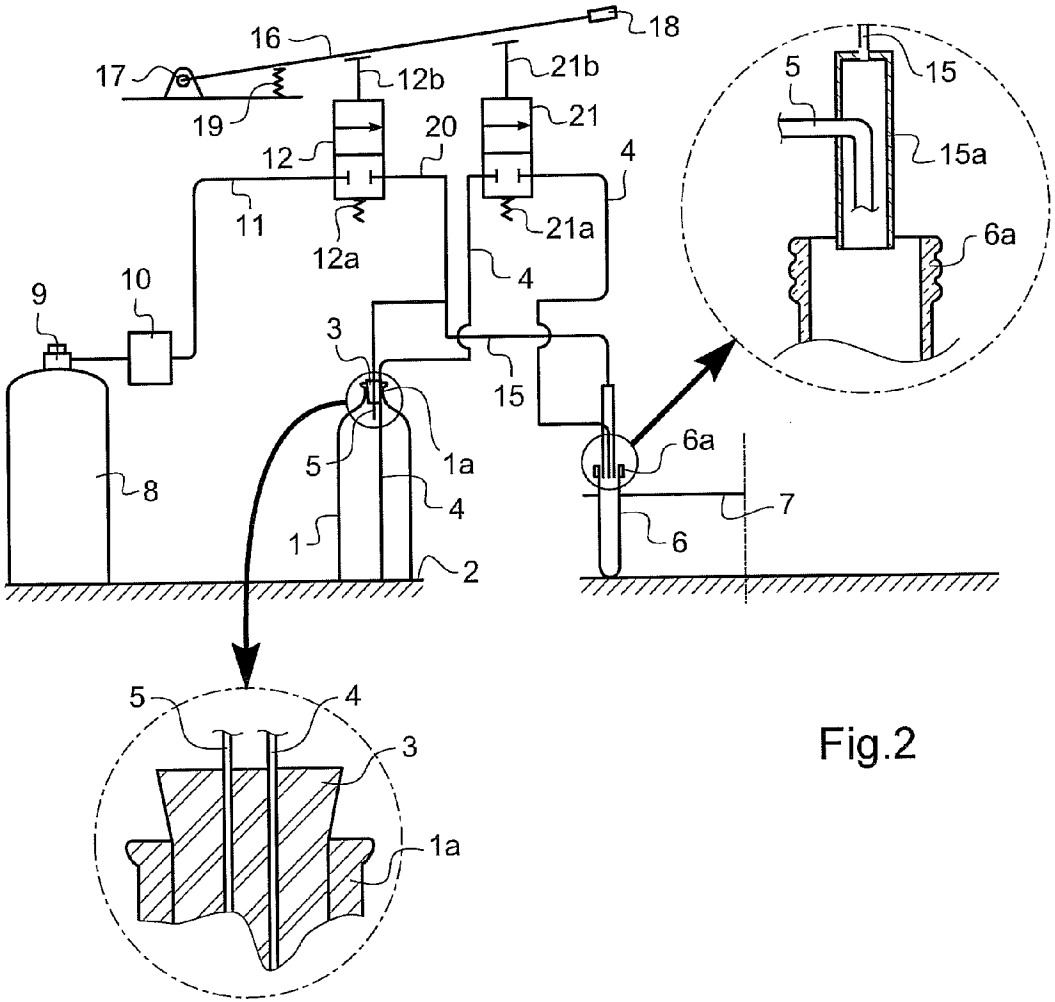
FIG. 2 is a diagram of a second embodiment of the invention.

In FIG. 2 certain elements that have already been described appear again with the same reference numbers. At the outlet of the directional control valve 12, the line 20 divides into two branches, one 5 of which is the branch for applying pressure to the larger bottle and the other 15 of which forms the branch for flushing the smaller bottle 6. The withdrawing line 4 ends in the smaller bottle 6 and passes through a directional control valve 21. This directional control valve 21 is a directional control slide valve which can be activated by a push-rod 21*b* against the effect of a spring 21*a* which acts to place this slide in its position of closing off the line 4. As in the preceding figure, the two directional control valves 12 and 21 are activated by the lever 16.

It will be understood that the opening sequence starts with the lines 11 and 20, so that the larger bottle is pressurized and the smaller bottle flushed by a flow of inert gas. Continuing the downward motion of the handle 18 causes the line 4 to open and enables filling of the smaller bottle 6. When the handle 18 is raised, the line 4 is closed before the pressurized gas line 11, 20. The operation of this variant embodiment is therefore identical to that of the embodiment shown in FIG. 1, with the withdrawal of the wine being better controlled.

Finally, in a variant that is not shown, the filling sequence is ensured by solenoid valves activated for example by means of programmed electronics that, on detection of an empty smaller bottle in the filling station, trigger the opening and closing sequence of the solenoid valves so as to complete a filling cycle such as described above.

The invention claimed is:

1. A device for dividing up a volume of liquid contained in an original container by filling bottles that are smaller than the original container, comprising:

a source of pressurized gas;

a first line running from the source of pressurized gas and opening into the original container so as to place it under pressure; and a line for withdrawing the contents of the original container, connecting the latter to one of the smaller bottles, wherein said device comprises:

a second line running from the source of pressure gas and ending in the smaller bottle to be filled, and valve means for closing and opening certain of said lines, which can only be activated in a fixed sequence so that gas flow starts in the second line before liquid starts to flow in the withdrawing line and stops after this flow of liquid has stopped; and wherein the valve means comprise directional control slide valves, the opening and closing of the two lines being ensured by a single activating handle which comprises a lever hinged about a pivot at one of its ends and which acts on push-rods of the directional control valve slides, located in the angular sector passed through by the lever during its motion about its pivot.

2. The device for dividing up as claimed in claim 1, wherein said valve means are placed on the first and second lines, a member for activating these means for closing/opening being arranged so as to open the second line then a pressurization line in sequence and close these same lines in sequence in the reverse order.

3. The device for dividing up as claimed in claim 1, wherein the first and second lines have a common section, said valve means comprising a first valve for opening/closing this common section and a second valve for opening/closing the withdrawing line, the lever being arranged so as to open the common section then the withdrawing line in sequence and close these lines in sequence in the reverse order.

4. The device as claimed in claim 1, wherein the withdrawing line is, where it opens into the smaller bottle, inside the second line.

* * * * *